US008887792B2

(12) United States Patent
Di Stefano

(10) Patent No.: US 8,887,792 B2
(45) Date of Patent: Nov. 18, 2014

(54) WINDER

(76) Inventor: Carmelo Joseph Licciardi Di Stefano, Broadmeadows (AU)

( * ) Notice: Subject to any disclaimer, the term of this patent is extended or adjusted under 35 U.S.C. 154(b) by 842 days.

(21) Appl. No.: 12/658,311

(22) Filed: Feb. 8, 2010

(65) Prior Publication Data

US 2010/0276530 A1 Nov. 4, 2010

(30) Foreign Application Priority Data

Feb. 9, 2009 (AU) ..... 2009900501

(51) Int. Cl.

| | |
|---|---|
| ***E06B 9/56*** | (2006.01) |
| ***A47G 5/02*** | (2006.01) |
| ***A47H 1/00*** | (2006.01) |
| ***E06B 9/50*** | (2006.01) |
| ***E06B 9/42*** | (2006.01) |
| *E06B 9/90* | (2006.01) |

(52) U.S. Cl.

CPC ..... *E06B 9/90* (2013.01); *E06B 2009/905* (2013.01); *E06B 9/50* (2013.01); *E06B 9/42* (2013.01)

USPC ..... 160/321; 160/309; 160/238; 160/291

(58) Field of Classification Search

USPC ..... 160/238, 309, 313, 291, 292, 298, 301, 160/307, 319, 318, 317, 315, 322, 323.1, 160/321, 168.1 V, 370, 193; 242/571.8

See application file for complete search history.

(56) References Cited

U.S. PATENT DOCUMENTS

| | | | | |
|---|---|---|---|---|
| 6,000,456 | A * | 12/1999 | Neverett | 160/178.1 V |
| 6,158,563 | A * | 12/2000 | Welfonder et al. | 192/223.3 |
| 7,497,242 | B2 * | 3/2009 | Wang | 160/321 |
| 7,549,458 | B2 * | 6/2009 | Kwak | 160/319 |
| 2007/0246172 | A1 | 10/2007 | Okoturo | A47G 5/02 |
| 2008/0142171 | A1 * | 6/2008 | Koop et al. | 160/243 |

FOREIGN PATENT DOCUMENTS

| | | | |
|---|---|---|---|
| CN | M301271 | | 4/2006 |
| CN | ZL200620113494.5 | * | 4/2007 |
| DE | 19514010 | | 10/1996 |
| JP | 2001-324554 | | 8/2003 |
| JP | 2005-321315 | | 5/2007 |

* cited by examiner

*Primary Examiner* — Katherine Mitchell
*Assistant Examiner* — Jeremy Ramsey
(74) *Attorney, Agent, or Firm* — Head, Johnson & Kachigian, P.C.

(57) ABSTRACT

A winder, including a support member having a wall portion and a spindle; and a housing rotatably mounted onto said spindle, said housing having a drive portion for receiving a cord that controls the rotation of said housing for extending and retracting a blind; wherein said housing is selectively moveable along the spindle between an open position and a closed position, such that when the housing is placed in the open position, the drive portion is exposed for receiving said cord, and when the housing is placed in the closed position, the wall portion covers at least a part of the drive portion to resist disengagement of the entire cord from the drive portion.

11 Claims, 5 Drawing Sheets

WINDER

FIELD

The present invention relates to a fitting for blind systems, and in particular, a winder for controlling the extension and retraction of a screen of a blind system.

BACKGROUND

A winder refers to a user-operated blind component (or fitting) that is rotatable for, for example, extending and retracting a cover or structure, such as a window blind. A winder can also be referred to as a clutch device or mechanism. Such fittings typically have a drive portion that engages a cord. The cord itself may or may not be beaded. For example, the cord may be referred to as a bead chain, which can be (but is not limited to) of a plastic or metal construction (or combinations thereof). The cord can be, but is not limited to, not and can be, but is not limited Operation of the cord allows the fitting to rotate. For example, the cord may be pulled in one direction to rotate the fitting in a blind extending direction, and the cord may be pulled in an opposite direction to rotate the fitting in a blind retracting direction.

During use, a user may attempt to pull the cord in various directions which may cause the cord to detach from (e.g. slide off from) the drive portion of the winder. It is necessary to reposition the cord onto the drive portion before the winder can be used again. To avoid such inconvenience, some winders include a sleeve that covers a part of the drive portion to minimise such detachment of the cord. However, there are several problems with this approach. If the sleeve is too flexible, it becomes ineffective for preventing detachment of the cord. If the sleeve is too rigid, it can be very difficult to initially attach the cord into the drive portion (e.g. during installation). Even if the sleeve is made to be both adequately flexible and rigid, it is still prone to cord detachment (e.g. if the cord is pulled too hard) or the sleeve may suffer from structural damage due to stress fatigue.

It is therefore desired to address one or more of the above issues or problems, or to at least provide a more useful alternative to existing winder fittings.

SUMMARY

According to the present invention, there is provided a winder, including:

a support member having a wall portion and a spindle; and a housing rotatably mounted onto said spindle, said housing having a drive portion for receiving a cord that controls the rotation of said housing for extending and retracting a blind;

wherein said housing is selectively moveable along the spindle between an open position and a closed position, such that when the housing is placed in the open position, the drive portion is exposed for receiving said cord, and when the housing is placed in the closed position, the wall portion covers at least a part of the drive portion to resist disengagement of the entire cord from the drive portion.

BRIEF DESCRIPTION OF THE DRAWINGS

Representative embodiments of the present invention are herein described, by way of example only, with reference to the accompanying drawings, wherein.

DETAILED DESCRIPTION OF THE REPRESENTATIVE EMBODIMENTS

Figure 1:
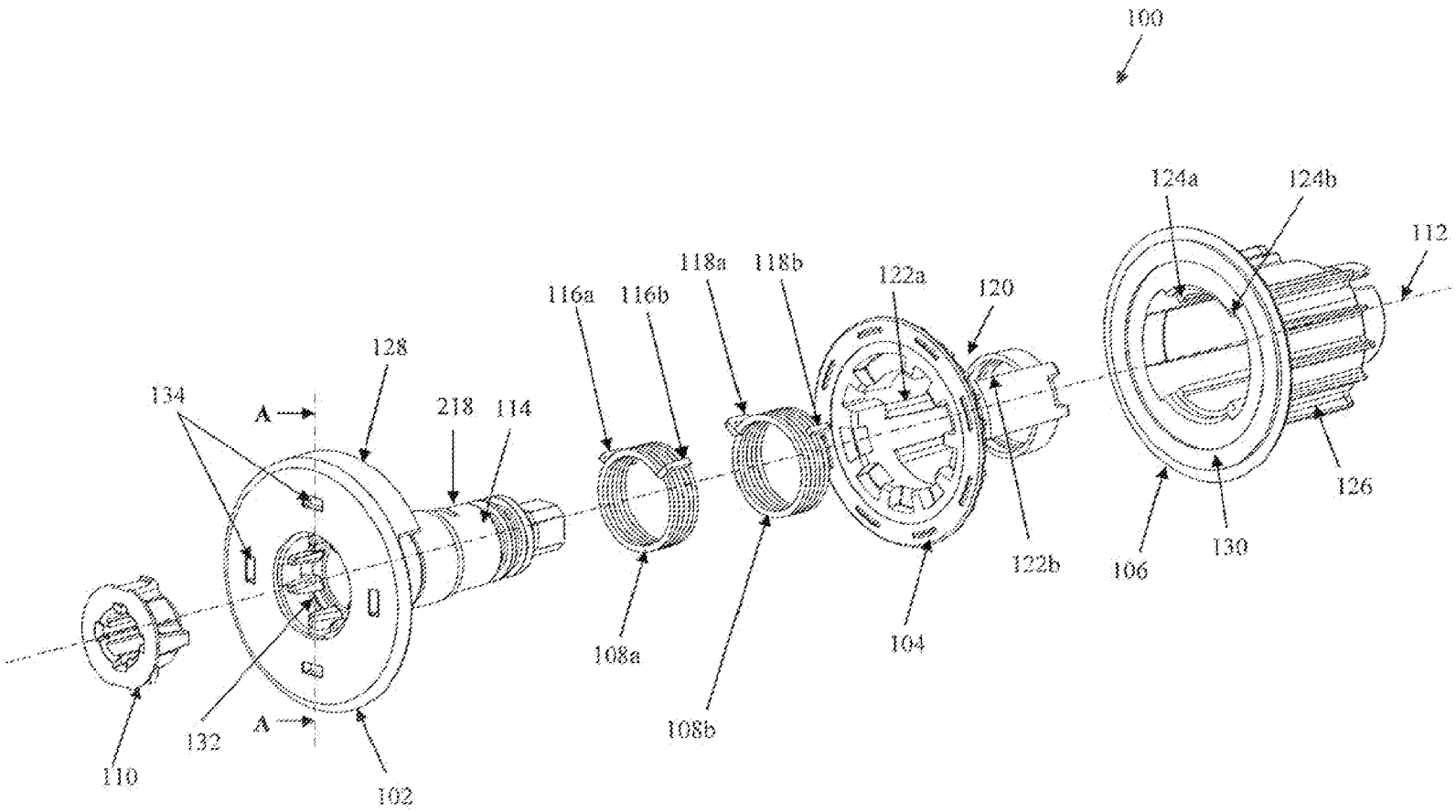
FIG. 1 is an exploded perspective view of the components of a winder.

A winder 100, as shown in FIG. 1, includes a support member 102, a housing 103 (which includes an inner core 104 and a body 106), and one or more clutch members 108*a* and 108*b*. The winder 100 may include an adapter 110, which enables the winder 100 to connect to different types of support structures (e.g. a supporting frame, structure, surface or mounting bracket).

Figure 9:
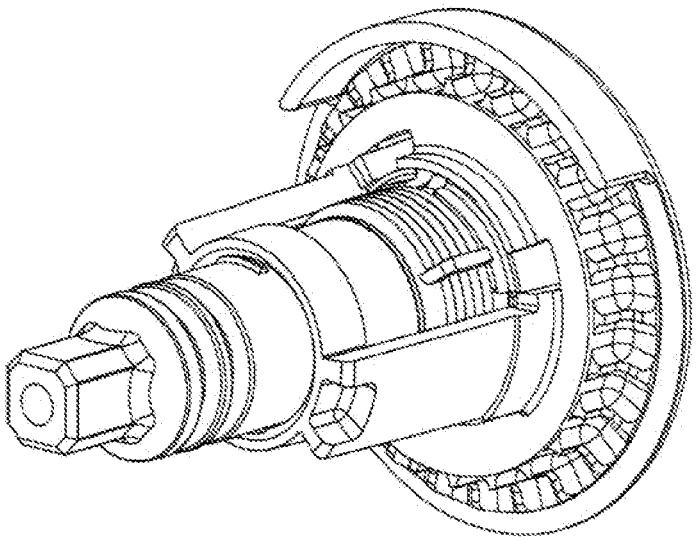
FIGS. 9 and 10 show a winder with one and two spring clutches respectively.
Figure 10:
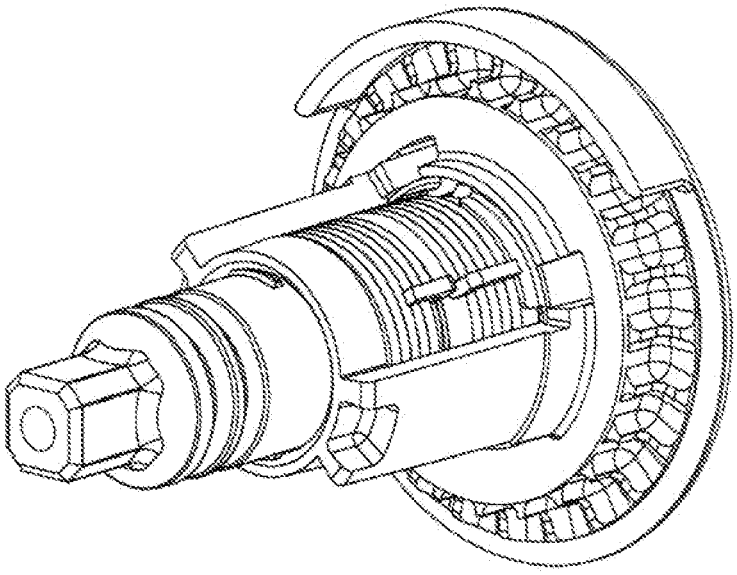

The support member 102 has a protruding portion referred to as a spindle 114. One or more of the clutch members 108*a* and 108*b* may be fitted over the spindle 114 so that, for example, each clutch member 108*a* and 108*b* engages a different respective portion of the outer surface of the spindle 114 (see FIGS. 9 and 10). In a representative embodiment, as shown in FIG. 1, each of the clutch members 108*a* and 108*b* is a coil spring with end portions 116*a*, 116*b*, 118*a* and 118*b*.

Figure 2:
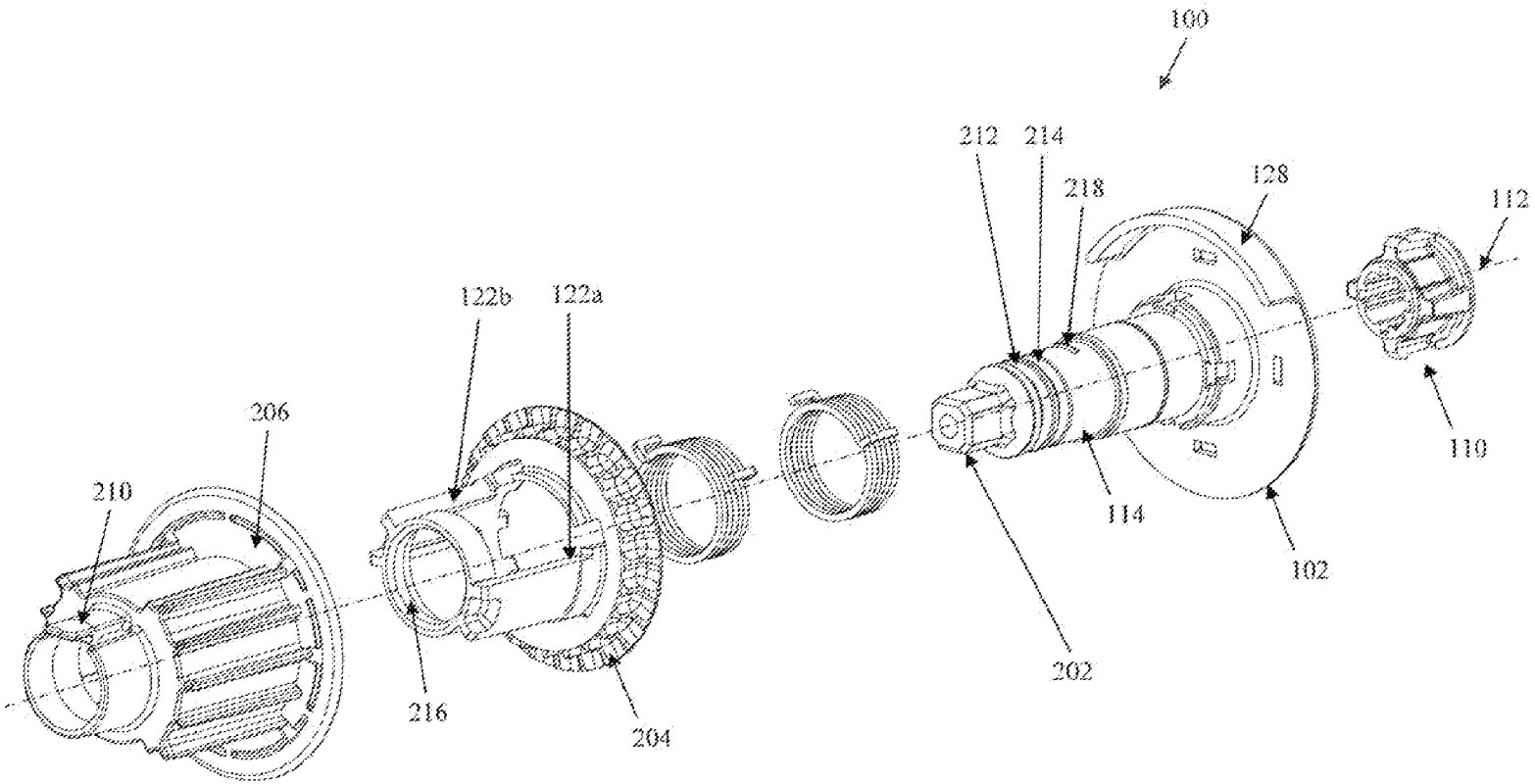
FIG. 2 is another exploded perspective view of the winder in FIG. 1.

As shown in FIG. 2, the spindle 114 has a connecting end portion 202 that is shaped for engaging a correspondingly shaped end of an axle (not shown in FIG. 2). The support member 102 also has a retaining wall portion 128.

The inner core 104 of the housing 103 fits over the spindle 114. The inner core 104 includes a drive portion 204 (which is best shown in FIG. 2) for engaging a section of a cord. A cord refers to a length of any material for engaging the drive portion 204 to cause the inner core 104 to rotate relative to the spindle 114. For example, the cord may be a chain (e.g. a bead chain) or a piece of string. In the example shown in FIG. 2, the drive portion has a plurality of flanged portions that form pockets for receiving different portions of the cord (e.g. different enlarged or beaded portion of a bead chain).

The inner core 104 also has at least one opening 120 along its side for the end portions 116*a*, 116*b*, 18*a* and 118*b* of the clutch members 108*a* and 108*b* to protrude through. Each opening 120 is defined by two opposingly faced driving wall portions 122*a* and 122*b*. In the example shown in FIG. 1, when the inner core 104 rotates in a clockwise direction, one of the driving wall portions 122*a* pushes the end portion 116*a* and 118*a* of the clutch members 108*a* and 108*b* towards the other end portion 116*b* and 118*b*. This increases the inner diameter of the clutch members 108*a* and 108*b* (thus reducing the frictional forces applied by the clutch members 108*a* and 108*b* to the spindle 114) to enable the inner core 104 to rotate in a clockwise direction relative to the spindle 114. Similarly, the inner core 104 can rotate in an anti-clockwise direction when the other of the driving wall portions 122*b* pushes the end portion 116*b* and 118*b* of the clutch members 108*a* and 108*b* towards the other end portion 116*a* and 118*a*.

The body 106 of the housing 103 has an outer surface that is shaped for engaging the inner surface of a tube (not shown in FIG. 1). When the body 106 is fitted to the tube, the body 106 rotates with the tube about the axis 112. In the example shown in FIG. 1, the outer surface of the body 106 has a plurality of fins for engaging the inner surface of the tube.

The body 106 also has a hollow core that is shaped for receiving the inner core 104 (e.g. when fitted over the support member 102 as described above). The hollow core defines at least two locking wall portions 124*a* and 124*b* for each opening 120. In the representative example shown in FIG. 1, when the body 106 rotates in an anti-clockwise direction, the locking wall portion 124*a* pushes the end portion 116*a* and 118*a* of the clutch members 108*a* and 108*b* away from the other end portion 116*b* and 118*b*. This decreases the inner diameter of the clutch members 108*a* and 108*b* (thus increasing the frictional forces applied by the clutch members to the spindle 114) to resist further (e.g. unwanted) rotation of the body 106 in an anti-clockwise direction relative to the spindle 114. Similarly, the clutch member 108*a* and 108*b* resist further (e.g. unwanted) rotation of the body 106 in a clockwise direction when the locking wall portion 124*b* pushes the end portions 116*b* and 118*b* away from the other end portion 116*a* and 118*a*.

An advantage of the present invention is that the housing 103 (i.e. the inner core 104 and the body 106) is selectively moveable along the spindle 114 between an open position and a closed position. This adjustable configuration is useful because it allows a user to easily attach the cord to the drive portion 204 (when the winder 100 is in the open position), and the winder 100 can be easily adjusted to the closed position by simply pushing the housing 103 towards the retaining wall portion 128. If the cord needs to be replaced at a later stage, it is possible to pull the housing 103 away from the retaining wall portion 128 so that the winder 100 is again configured in the open position where the drive portion 204 is exposed for receiving a new cord.

Figure 3:
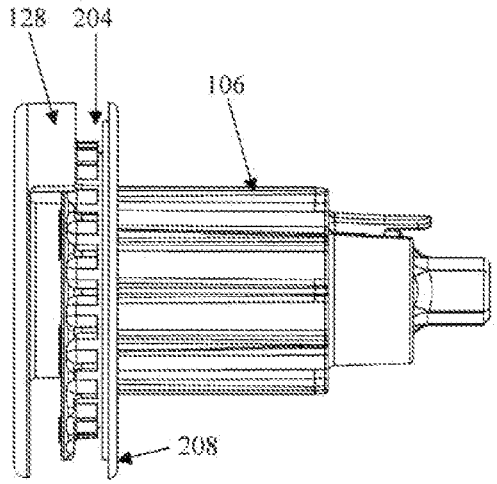
FIG. 3 is side view of a winder in an open configuration.
Figure 4:
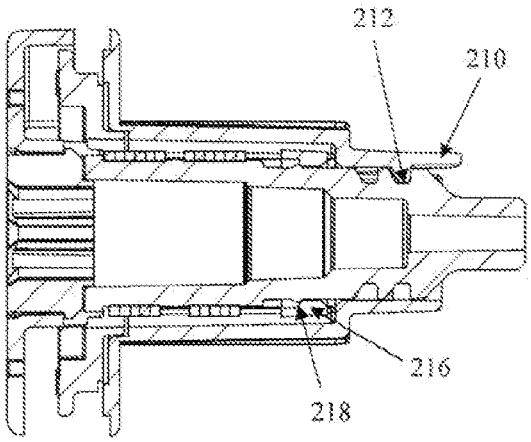
FIG. 4 is a cross-sectional view (along section A-A) of the winder in FIG. 3.
Figure 5:
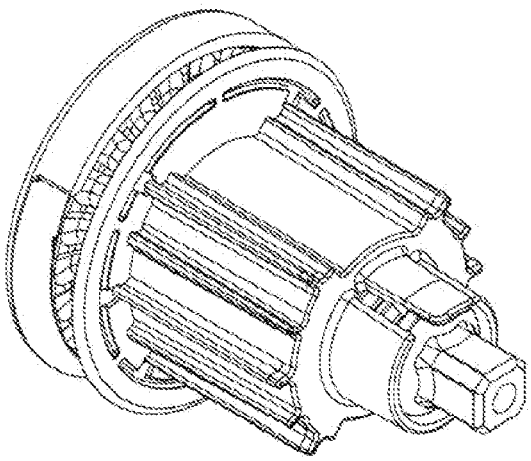
FIG. 5 is a perspective view of the winder in FIG. 3.

FIG. 3 is a side view of the winder 100 (in the assembled form) configured in the open position. In the open position, the housing 103 is positioned away from the retaining wall portion 128 so that drive portion 204 is exposed for receiving the cord. FIG. 4 is a cross-sectional view of the winder 100 (along section A-A in FIG. 1) in the open position. FIG. 5 is a perspective view of the winder 100 in the open position.

Figure 6:
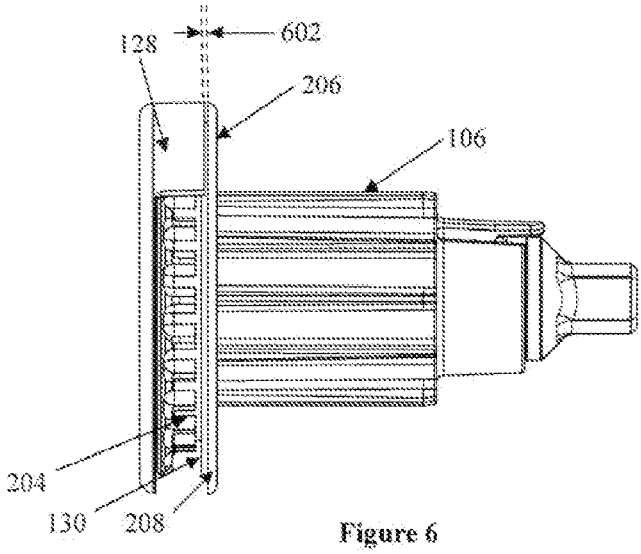
FIG. 6 is a side view of a winder in a closed configuration.
Figure 7:
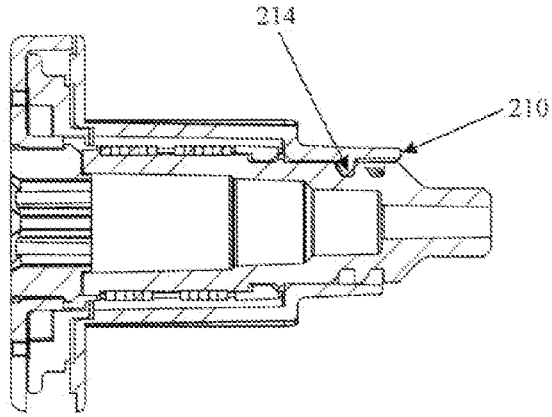
FIG. 7 is a cross-sectional view (along section A-A) of the winder in FIG. 6.
Figure 8:
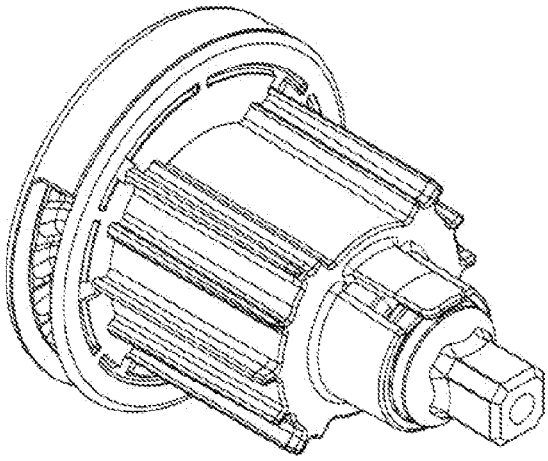
FIG. 8 is a perspective view of the winder in FIG. 6.

FIG. 6 is a side view of the winder 100 (in the assembled form) configured in the closed position. In the closed position, the housing 103 is positioned so that the retaining wall portion 128 covers at least a part of the drive portion 204 to resist disengagement of the entire cord from the drive portion 204. FIG. 7 is a cross-sectional view of the winder 100 (along section A-A in FIG. 1) in the closed position. FIG. 8 is a perspective view of the winder 100 in the closed position.

In the closed position (as shown in FIG. 6), the retaining wall portion 128 is located sufficiently close to a flanged portion 206 of the body 106 so that any gap 602 formed between the wall 128 and the flanged portion 206 is sufficiently small to resist movement of the cord through that gap 602. For example, the gap 602 is less than the smallest diameter of the cord. Preferably, no gap 602 is formed when the winder 100 is placed in the closed position.

In a representative embodiment, the body 106 has a flanged portion 206 that is placed adjacent to the drive portion 204 when the winder 100 is assembled. The flanged portion 206 acts as a support surface that helps resist detachment of the cord from the drive portion 204 (e.g. during use). The flanged portion 206 may include a rim 130, and may have an overall thickness that is determined based on the pitch of a chain (or cord) received in the drive portion 204. For example, the thickness of the flanged portion 206 (with the rim 130) may be slightly less than the pitch of a bead chain (i.e. the distance between the beaded portions of the chain). This helps prevent the links between the beaded portions (which generally have a smaller diameter) from coming into contact with a peripheral edge 208 of the flanged portion 206 to minimise a link of the chain from being inadvertently forced into (and pulled through) the gap 602, which can result in disengagement of the entire chain from the drive portion 204.

Referring to FIG. 2, the body 106 has a protruding portion referred to as the retaining arm 210 that has an enlarged head portion (or an enlarged portion located anywhere along the retaining arm 210) for engaging one of the two grooves 212 and 214 formed on the outer surface of the spindle 114. When the housing 103 is configured in the open position, the enlarged portion of the retaining arm 210 engages a first groove 212, which is located further away from the retaining wall portion 128 of the support member 102. When the housing 103 is configured in the closed position, the enlarged portion of the retaining arm 210 engages a second groove 214, which is located closer to the retaining wall portion 128 of the support member 102.

As shown in FIGS. 2 and 4, the enlarged portion of the retaining arm 210 engages the first groove 212 when the winder 100 is initially assembled. The engagement between the enlarged portion of the retaining arm 210 and the first groove 212 resists lateral movement of the body 106 along the spindle 114 towards the retaining wall portion 128. In this way, the body 106 is effectively held at a certain distance away from the retaining wall portion 128 (i.e. in the open position).

The retaining arm 210 is made from a rigid material. In a representative embodiment, the retaining arm 210 is biased towards a first position for engaging one of the first and second grooves, and is also adjustable to a second position for disengaging the retaining arm from one of the first and second grooves.

The inner core 104 has a protruding first rib portion 216 that is initially positioned to rest against one side of a second rib portion 218 (on the outer surface of the spindle 114). The engagement between the first and second rib portions 216 and 218 resists lateral movement of the inner core 104 along the spindle 114 towards the retaining wall portion 128. In this way, the inner core 104 is effectively held at a certain distance away from the retaining wall portion 128 (i.e. in the open position) so that the drive portion 204 is exposed for receiving a cord.

As shown in FIG. 4, the body 106 can be pushed towards the retaining wall portion 128 for configuring the winder 100 to the closed position (e.g. after the cord is received into the drive portion 204. This pushing action causes the retaining arm 210 to flex, which causes the enlarged portion of the retaining arm 210 to disengage from the first groove 212. As the body 106 moves towards the retaining wall portion 128, the enlarged portion of the retaining arm 210 returns to its original (i.e. unflexed) position and is received into the second groove 214 (i.e. in the close position as shown in FIG. 7), and the engagement between the enlarged portion of the retaining arm 210 and the second groove 214 resists lateral movement of the body 106 along the spindle 114 away from the retaining wall portion 128.

Similarly, when the inner core 104 is pushed towards the retaining wall portion 128, either one or both of the first and second rib portions 216 and 218 flex to allow inner core 104 to move closer towards the retaining wall portion 128 (i.e. in the closed position). In the close position, the engagement between the first and second rib portions 216 and 218 resists lateral movement of the inner core 104 along the spindle 114 away from the retaining wall portion 128.

Referring to FIG. 1, the support member 102 has a connecting portion 132 that is adapted for engaging a portion of a mounting bracket (not shown in FIG. 1) for supporting the winder 100 during use. For example, the connecting portion 132 may be shaped for receiving a projection extending from the mounting bracket, or alternatively, the connecting portion 132 may include a projection that is shaped for being received by the mounting bracket. In a representative embodiment, the connecting portion 132 is a hollow core shaped for receiving a projection from the mounting bracket. The hollow may have a cross-sectional shape corresponding to the cross-sectional shape of the projection from the mounting bracket, so that the projection can form a locking engagement with the hollow 132 to resist rotation of the support member 102 relative to the mounting bracket.

In another representative embodiment, the connecting portion 132 is a hollow shaped for receiving an adapter 110. Different adapters can have a hollow core of different cross-sectional size and/or shape for receiving different types of projections (e.g. a projection from a mounting bracket or an end of an axle from another winder or idler assembly). This is particularly advantageous as a specific adapter 110 (with a suitable cross-sectional size or shape) can be selected from a range of different adapters 110 (with different cross-sectional size and/or shape) for attaching to the support member 102. This allows the support member 102 to be configured for use with a wider range of mounting structures.

The support member 102 may also have one or more openings 134 shaped for receiving correspondingly shaped support arms (not shown in FIG. 1) or flanges from a supporting structure (e.g. a mounting bracket or similar installation) for supporting the winder 100. The engagement between the support arms and openings 134 also resists rotation of the support member 102 relative to the supporting structure.

Modifications and improvements to the invention will be readily apparent to those skilled in the art. Such modifications and improvements are intended to be within the scope of this invention.

In this specification where a document, act or item of knowledge is referred to or discussed, this reference or discussion is not an admission that the document, act or item of knowledge or any combination thereof was at the priority date, publicly available, known to the public, part of common general knowledge; or known to be relevant to an attempt to solve any problem with which this specification is concerned.

The word 'comprising' and forms of the word 'comprising' as used in this description and in the claims does not limit the invention claimed to exclude any variants or additions.

What is claimed is:

1. A winder, including a support member, said support member comprising:

(a) a wall portion;

(b) a spindle;

(c) a housing rotatably mounted onto said spindle, said housing having:

(i) a drive portion receiving a cord that controls the rotation of said housing extending and retracting a blind, and;

(ii) a protruding retaining arm extending parallel to an axis of said spindle exterior to said spindle, wherein said retaining arm has at least one enlarged portion;

wherein said housing is selectively moveable along the spindle between an open position and a closed position, such that:

(A) when the housing is placed in the open position, the drive portion is exposed for receiving said cord, and (B) when the housing is placed in the closed position, the wall portion covers at least a part of the drive portion to resist disengagement of the entire cord from the drive portion, (d) a first groove for receiving said at least one enlarged portion of the retaining arm when the housing is in the open position; and (e) a second groove for receiving said at least one enlarged portion of the retaining arm when the housing is in the closed position;

wherein, when said retaining arm is received in either of the first and second grooves, the retaining arm resists movement of the housing along said spindle.

2. A winder as claimed in claim 1, wherein said retaining arm is biased towards a first position for engaging one of first and second grooves, said retaining arm being adjustable to a second position for disengaging the retaining arm from one of the first and second grooves.

3. A winder as claimed in claim 1, wherein said housing has a flange portion for positioning adjacent to said wall portion when said housing is placed in the closed position, and wherein any gap between the flange portion and the wall portion is sufficiently small for resisting movement of said cord through said gap.

4. A winder as claimed in claim 3, wherein said gap is less than the smallest diameter of the cord.

5. A winder as claimed in claim 3, wherein said flange portion is shaped so that any section of the cord having a smaller diameter does not come into contact with a peripheral edge of said flange portion.

6. A winder as claimed in claim 1, wherein:

the housing includes:

an inner core including said drive portion; and a body, fitted around said inner core, for engaging a tube for extending and retracting the blind; and the winder includes a clutch located between said spindle and said housing, such that when said body rotates in a first direction relative to the spindle, said clutch engages the spindle to resist further rotation of said body in the first direction, and when said housing rotates with said body in an opposite direction, said clutch releases the spindle to allow rotation of said housing and said body in the opposite direction.

7. A winder as claimed in claim 6, wherein said inner core includes a groove shaped for receiving a rib formed on an outer portion of the spindle, such that when said housing is placed in said open position, the rib is received in said groove to form a locking engagement that resists movement of the inner core relative to the spindle.

8. A winder as claimed in claim 1, wherein said support member further has a connecting portion adapted for engaging a portion of a mounting bracket for supporting said winder.

9. A winder as claimed in claim 8, wherein said connecting portion is a hollow shaped for receiving a projection extending from said mounting bracket.

10. A winder as claimed in claim 8, wherein said connecting portion is a hollow shaped for receiving an adapter, said adapter being shaped for receiving said projection.

11. A winder as claimed in claim 1, wherein said support member further has one or more openings shaped for receiving correspondingly shaped support arms extending from a mounting bracket for support said winder.

* * * * *